US007450886B2

(12) United States Patent
Ahn et al.

(10) Patent No.: US 7,450,886 B2
(45) Date of Patent: Nov. 11, 2008

(54) DEVELOPER-DRIVING DEVICE AND IMAGE FORMING APPARATUS HAVING THE SAME

(75) Inventors: Byeong-hwa Ahn, Seongnam-si (KR); Seock-deock Hong, Suwon-si (KR); Se-hyun Lyu, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 374 days.

(21) Appl. No.: 11/338,814

(22) Filed: Jan. 25, 2006

(65) Prior Publication Data

US 2006/0257166 A1 Nov. 16, 2006

(30) Foreign Application Priority Data

May 13, 2005 (KR) ..... 10-2005-0040143

(51) Int. Cl.
*G03G 15/00* (2006.01)

(52) U.S. Cl. ..... 399/167

(58) Field of Classification Search ..... 399/167
See application file for complete search history.

(56) References Cited

U.S. PATENT DOCUMENTS 6,016,416 A * 1/2000 Kitamura ..... 399/167

FOREIGN PATENT DOCUMENTS

| | | | |
|---|---|---|---|
| JP | 02039059 A | * | 2/1990 |
| JP | 07-248683 | | 9/1995 |
| JP | 2000019844 A | * | 1/2000 |
| JP | 2003263005 A | * | 9/2003 |
| JP | 2004029616 A | * | 1/2004 |
| KR | 93-3247 | | 2/1993 |
| KR | 94-4030 | | 2/1994 |
| KR | U1999-0017998 | | 6/1999 |
| KR | 10-0429812 | | 5/2004 |

* cited by examiner

*Primary Examiner*—David M Gray
*Assistant Examiner*—Erika J. Villaluna
(74) *Attorney, Agent, or Firm*—Roylance, Abrams, Berdo & Goodman, L.L.P.

(57) ABSTRACT

A developer-driving device and an image forming apparatus having the same are provided. The developer-driving device includes a photosensitive drum-driving unit that rotates a photosensitive drum and a developing roller-driving unit that rotates a developing roller. Each of the photosensitive drum-driving unit and the developing roller-driving unit includes a one-way power transmission unit. The one-way power transmission unit idles when a developer is being mounted on a main body and transmits power to the photosensitive drum and the developing roller after the developer is mounted on the main body.

16 Claims, 4 Drawing Sheets

DEVELOPER-DRIVING DEVICE AND IMAGE FORMING APPARATUS HAVING THE SAME

CROSS-REFERENCE TO RELATED PATENT APPLICATION

This application claims the benefit under 35 U.S.C. § 119 (a) of Korean Patent Application No. 10-2005-0040143, filed on May 13, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to a developer-driving device of an image forming apparatus that drives a developing roller and a photosensitive medium that contact each other.

2. Description of the Related Art

Generally, an electrophotographic image forming apparatus is designed to form an image by radiating light on a photosensitive medium charged to a uniform electric potential to form an electrostatic latent image corresponding to a desired image thereon. The electrostatic latent image is developed by supplying toner. The image developed on the photosensitive medium is transferred onto paper via an intermediate transfer medium or may be transferred directly onto the paper. The transferred image is fixed on the paper by applying heat and pressure.

Electrophotographic image forming apparatuses are classified into non-contact developing types and contact developing types according to whether a developing roller and a photosensitive medium contact each other.

In the non-contact developing type, the developing roller is spaced apart from the photosensitive medium by a developing gap. The developing gap is a very important factor for determining the developing efficiency and the image quality. Therefore, the developing gap should be uniformly maintained during a printing process.

In the contact developing type electrophotographic image forming apparatuses, the developing roller contacts the photosensitive medium. In some contact-type apparatuses, the photosensitive medium and the developing roller may contact each other in a developer. In such an apparatus, when the developer is mounted on a main body, a developing roller gear and a photosensitive medium gear are engaged with a developing roller driving gear and a photosensitive medium-driving gear, respectively.

When teeth of the developing roller gear and the photosensitive medium gear collide with teeth of the developing roller driving gear and the photosensitive medium driving gear, any one of the gears must rotate to be completely engaged with the other gear. Since the developing roller driving gear and the photosensitive medium driving gear are, respectively, connected to driving motors by connecting gears, they cannot easily rotate due to the high load. On the contrary, the developing roller gear and the photosensitive medium gear can rotate relatively easily.

However, when the developing roller gear and the photosensitive medium gear, particularly the developing roller gear, rotate in a reverse direction, a metering blade that adjusts the toner to a uniform thickness by contacting an outer circumference of the developing roller, may be bent, and thus, the metering blade may not work properly. A bent metering blade may cause the gears to not engage each other.

Therefore, a method is needed by which when the developer is mounted on the main body, the developing roller and the photosensitive medium do not rotate in the reverse direction and the developing roller-driving gear and the photosensitive medium-driving gear rotate.

Accordingly, a need exists for an image forming apparatus having an improved developer-driving device that drives a developing roller and a photosensitive medium that contact each other.

SUMMARY OF THE INVENTION

The present invention provides a developer-driving device of an image forming apparatus having a one-way power transmission unit that prevents a developing roller and a photosensitive medium from rotating in a reverse direction by allowing a developing roller driving gear and a photosensitive medium-driving gear disposed in a main body to rotate when a developer is mounted on a main body.

According to an aspect of the present invention, a developer-driving device includes a photosensitive drum-driving unit that rotates a photosensitive drum and a developing roller-driving unit that rotates a developing roller. Each of the photosensitive drum-driving unit and the developing roller-driving unit includes a one-way power transmission unit. The one-way power transmission unit idles when a developer is being mounted on a main body and transmits power to the photosensitive drum and the developing roller after the developer is mounted on the main body.

According to another aspect of the present invention, an image forming apparatus includes a photosensitive drum, a plurality of developers each having a developing roller that develops an electrostatic latent image formed on the photosensitive drum, a conveying belt that conveys paper in response to the developers, and a developer-driving device that drives the developers. The developer-driving device includes a photosensitive drum-driving unit that rotates the photosensitive drum and a developing roller-driving unit that rotates the developing roller. Each of the photosensitive drum-driving unit and the developing roller-driving unit includes a one-way power transmission unit. The one-way power transmission unit idles when the developer is being mounted on a main body and transmits power to the photosensitive drum and the developing roller after the developer is mounted on the main body.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 1:
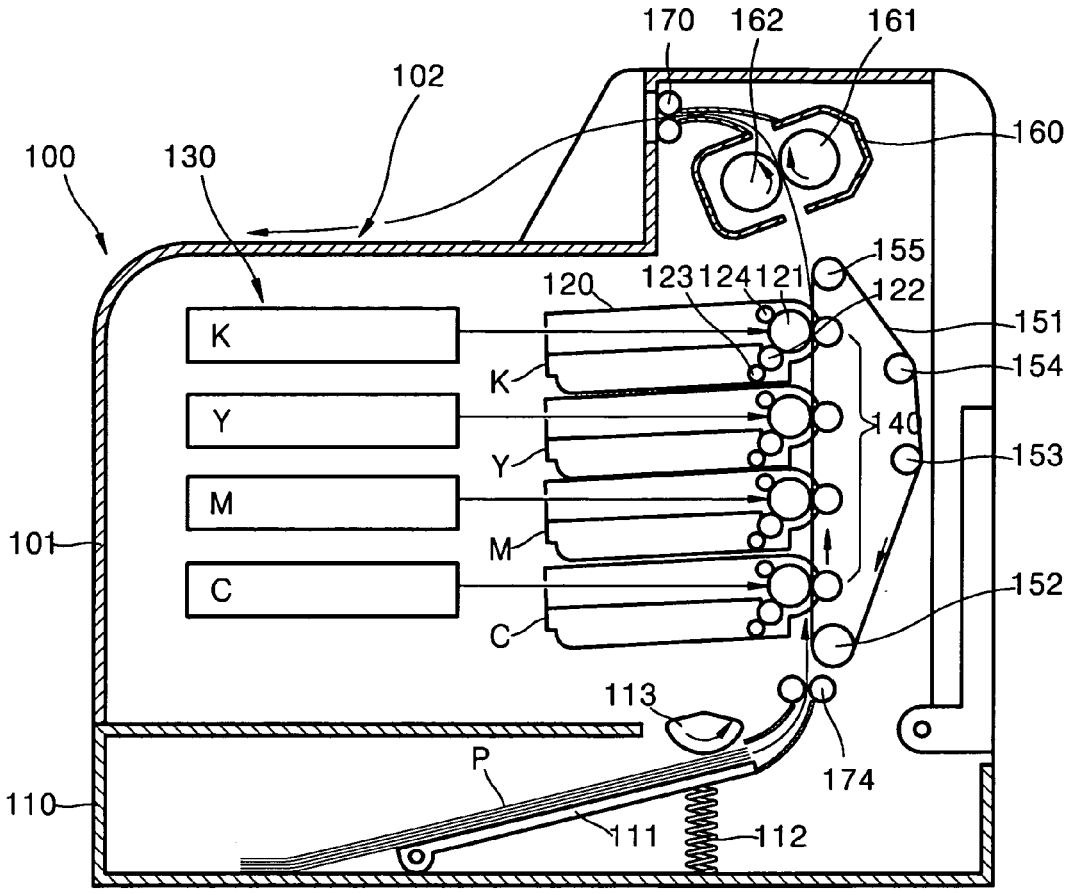
FIG. 1 is an elevational view in partial cross section of an image forming apparatus having a developer-driving device according to an exemplary embodiment of the present invention.

Referring to FIG. 1, an image forming apparatus 100 prints an image on a recording medium through an electrophotographic process and includes a main body 101 and a cassette 110, on which a plurality of recording media P are stacked, detachably installed in the main body 101.

The cassette 110 includes a paper support board 111 that is elastically biased in an upward direction by a spring 112 and on which the recording media P are stacked. A pickup roller 113 is installed proximal an upper portion of the cassette 110 to pick up the recording media P piece by piece.

The image forming apparatus 100 further includes a developer 120, an exposure unit 130, a transfer roller 140, a conveying belt 151, a fusing unit 160, and a paper discharging unit 170.

The developer 120 stores toner and develops an electrostatic latent image as a toner image by supplying the toner to the electrostatic latent image. The developer 120 includes a plurality of developing units 120C, 120M, 120Y, and 120K in which toner representing a plurality of colors is stored. The developer 120 includes a photosensitive drum 121 on which an electrostatic latent image corresponding to a desired image is formed by the exposure unit 130, a developing roller 122 that develops the electrostatic latent image as a toner image by supplying the toner to the electrostatic latent image, a toner supplying roller 123 that supplies the toner to the developing roller 122, and a charging roller 124 that charges a surface of the photosensitive drum 121 to a predetermined electric potential.

Figure 2:
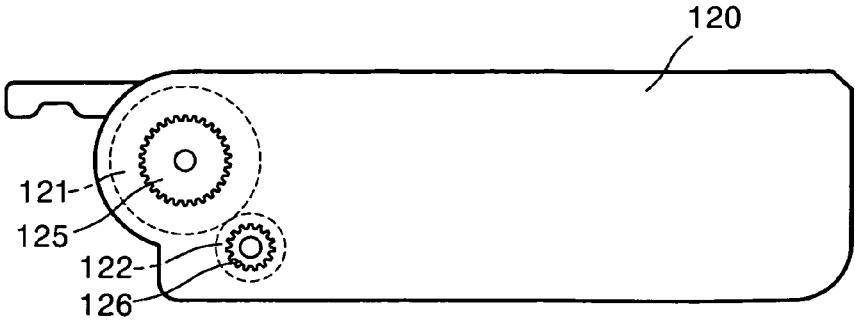
FIG. 2 is an elevational view of a developer illustrated in FIG. 1.

The photosensitive drum 121 and the developing roller 122 are respectively provided with a photosensitive drum gear 125 and a developing roller gear 126 that protrude from the developer 120 to receive power from the outside, as shown in FIG. 2. Therefore, when the developer 120 is mounted on the main body 101, it is connected to a developer-driving device 180 (FIG. 3) disposed inside of the main body 101 to receive power therefrom.

Figure 3:
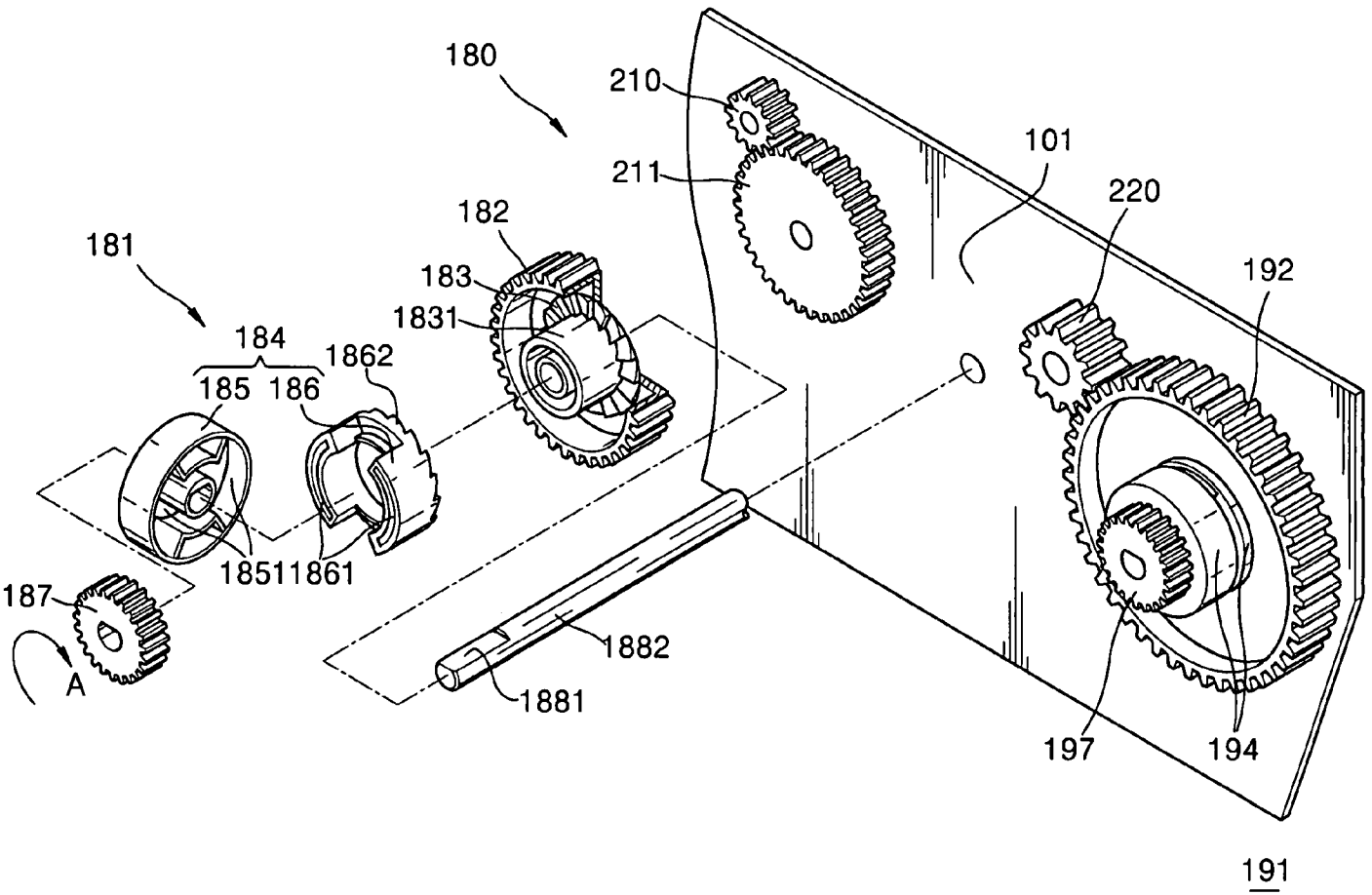
FIG. 3 is an exploded perspective view of a developer-driving device according to an exemplary embodiment of the present invention.

The developer-driving device 180 has a developer roller-driving unit 181 and a photosensitive-driving unit 191, as shown in FIG. 3.

The developing roller-driving unit 181 includes a reduction gear 182, a one-way power transmission unit 184 and a developing roller-driving gear 187. The reduction gear 182 is slidably installed on a rotational shaft 1882, which is rotatably installed on the main body 101, and connected to a developing roller-driving source 210 by a connecting gear 211 to receive power therefrom.

The reduction gear 182 is provided with driving teeth 183 arranged in a stair shape facing the one-way power transmission unit 184.

The one-way power transmission unit 184 is disposed between the developing roller-driving gear 187 and the reduction gear 182 and includes first and second clutches 185 and 186.

The first clutch 185 is inserted into a key 1881 formed on the rotational shaft 1882 and provided at a portion facing the second clutch 186 with a plurality of concave portions 1851 spaced from each other at a predetermined interval.

The second clutch 186 is disposed between the first clutch 185 and the reduction gear 182 and supported by a supporting portion 1831 that protrudes from the reduction gear 182. The second clutch 186 is provided at a portion facing the first clutch 185 with a plurality of projections 1861 inserted to the concave portions 1851 and at a portion facing the reduction gear 182 with driven teeth 1862 that are adapted to engage the driving teeth 183.

The reduction gear 182 is provided to enclose the supporting portion 1831. The developing roller-driving gear 187 is fixed on the rotational shaft 1882 and engaged with the developing roller gear 126 to transmit rotational power transmitted from the developing roller-driving source 210 to the developing roller gear 126.

The photosensitive drum-driving unit 191 is identically constituted to the developing roller-driving unit 181. That is, the photosensitive drum-driving unit 191 includes a reduction gear 192, which is engaged with the photosensitive drum-driving source 220 to receive rotational power therefrom, and a one-way power transmission unit 194 disposed between the reduction gear 192 and the photosensitive drum-driving gear 197.

The operation of the developing roller-driving unit 181 and the photosensitive drum-driving unit 191 are hereafter described with reference to the accompanying drawings.

Figure 6:
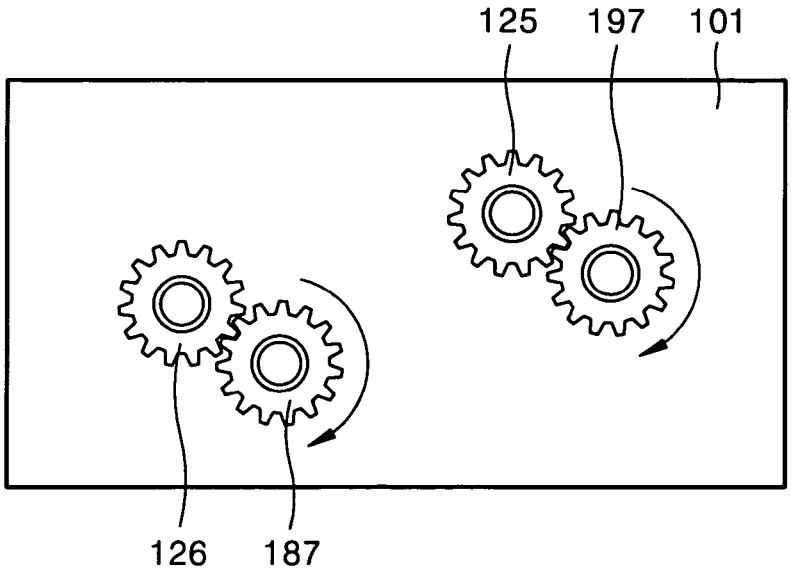

Referring to FIGS. 1, 2, 3, 5 and 6, when the developer 120 is mounted on the main body 101, although teeth of the photosensitive drum gear 125 and the developing roller gear 126 collide with teeth of the photosensitive drum-driving gear 197 and the developing roller-driving gear 187, since the photosensitive drum-driving gear 197 and the developing roller-driving gear 187 rotate in a direction indicated by arrow A as shown in FIG. 6, the photosensitive drum gear 125 is engaged with the photosensitive drum-driving gear 197 and the developing roller gear 126 is engaged with the developing roller-driving gear 187.

That is, when the developing roller-driving gear 187 rotates, the first clutch 185 rotates together with the rotational shaft 1882 and the second clutch 186 rotates together with the first clutch 185. However, since the driven teeth 1862 are not engaged with the driving teeth 183 and slide, the reduction gear 182 is not rotated while being engaged with the developing roller-driving source 210 and the connecting gear 211. Thus, the developing roller-driving gear 187 rotates to be engaged with the developing roller gear 126.

The photosensitive drum-driving gear 197 is engaged with the photosensitive drum gear 125 through the same operation as described above.

When the developing roller-driving source 210 rotates in the direction indicated by arrow A, a rotational force is transmitted to the reduction gear 182 through the connecting gear 211. The reduction gear 182 rotates in the direction indicated by arrow A of FIG. 6 so that the driving teeth 183 and the driven teeth 1862 are engaged with each other. Thus, the second clutch 186 rotates in the direction indicated by arrow A of FIG. 6 and the first clutch 185 is connected to the second clutch 186 to rotate together therewith.

When the first clutch 185 rotates, the rotational shaft 188 rotates. Therefore, the developing roller-driving gear 187 rotates in the direction indicated by arrow A of FIG. 6 to rotate the developing roller gear 126 connected thereto.

When the photosensitive drum-driving source 220 rotates in the direction indicated by arrow A of FIG. 6, the photosensitive drum gear 125 rotates through the same operation as described above.

Thus, when the developer 120 is mounted on the main body 101, the one-way power transmission units 181 and 191 rotate the developing roller-driving gear 187 and the photosensitive drum-driving gear 197 so that the developing roller-driving gear 187 and the photosensitive drum-driving gear 197 may be respectively engaged with the developing roller gear 126 and the photosensitive drum gear 125. During the printing operation after the mounting of the developer 120 on the main body 101 is completed, the one-way power transmission units 181 and 191 transmit the rotational force transmitted from the developing roller-driving source 210 and the photo-drum driving source 220 to the developing roller-driving gear 187 and the photosensitive drum-driving gear 197 to rotate the developing roller gear 126 and the photosensitive drum gear 125.

Figure 4:
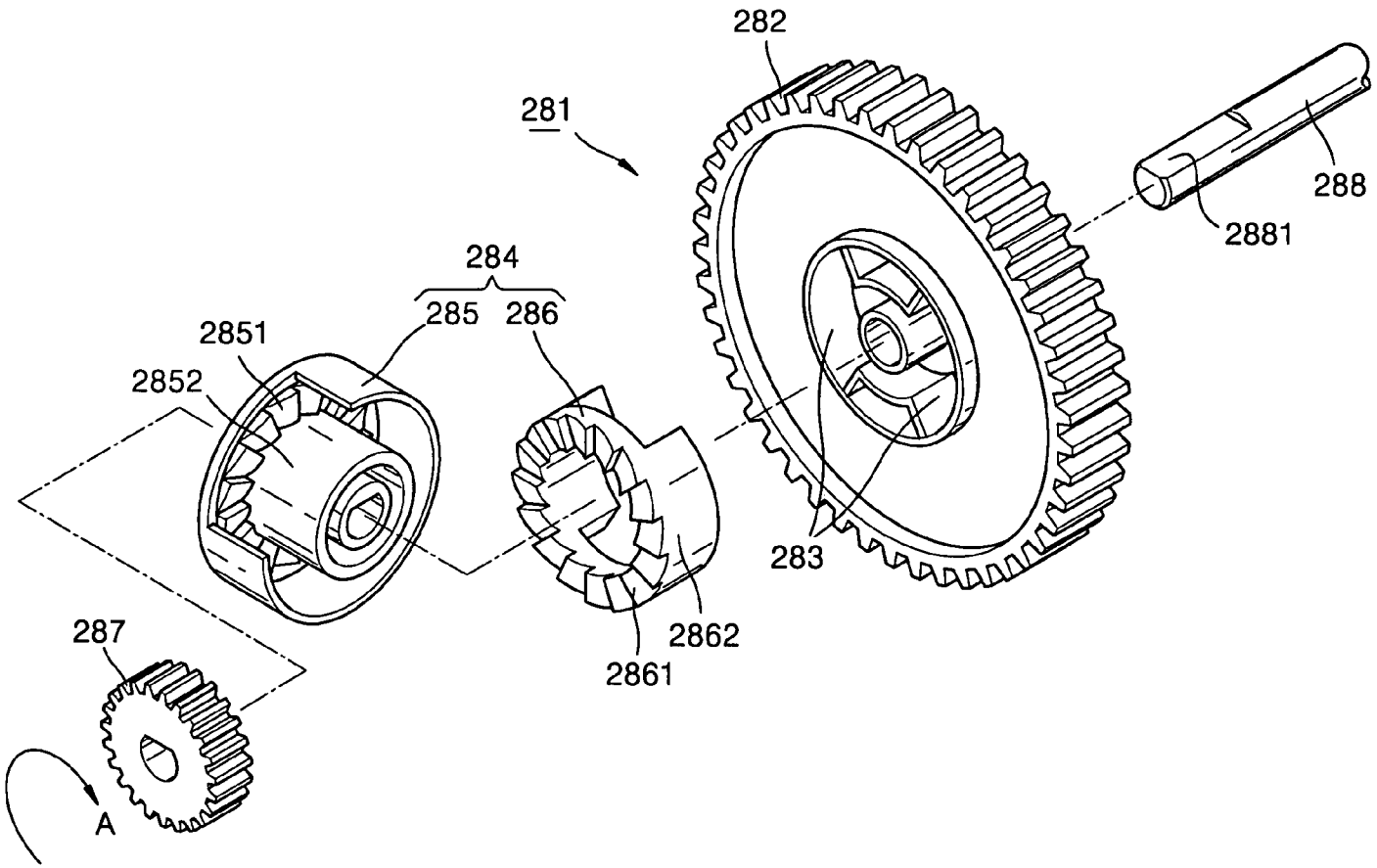
FIG. 4 is an exploded perspective view of a developer-driving device according to another exemplary embodiment of the present invention.
Figure 5:
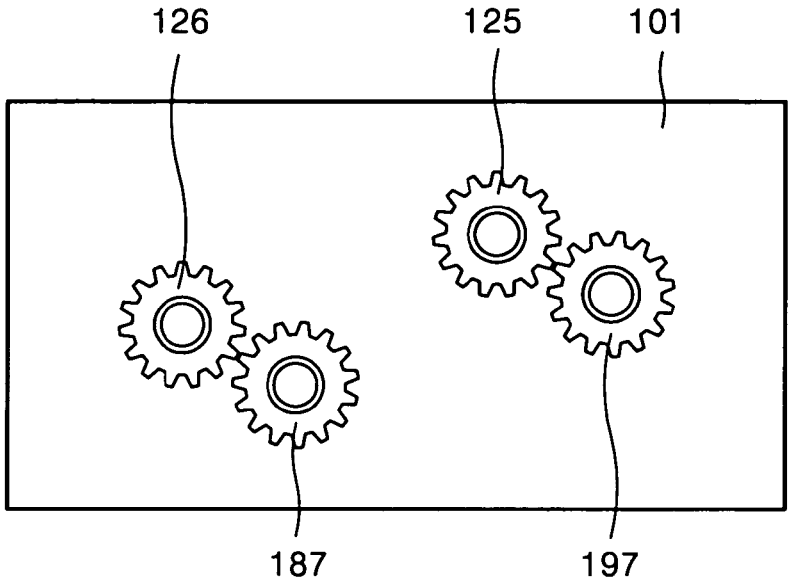
FIGS. 5 and 6 diagrammatic illustrations of the operation of a developer-driving device of FIG. 3 or 4.

The driving principle of a developer-driving device of another exemplary embodiment shown in FIG. 4 is substantially similar to that of the developer-driving device shown in FIG. 3 except for the locations of the driving teeth, the driven teeth, the projections, and concave portions. Because a developing roller-driving unit and a photosensitive drum-driving unit are substantially similar to each other, only the developing roller-driving unit is hereafter described.

That is, a developing roller-driving unit 281 includes a reduction gear 282, a one-way power transmission unit 284 and a developing roller-driving gear 287. The reduction gear 282 is slidably installed on a rotational shaft 288, which is rotatably installed on a main body (see 101 of FIG. 1).

The reduction gear 282 is provided at a portion facing the one-way power transmission unit 284 with a plurality of concave portions 283.

The one-way power transmission unit 284 is disposed between the developing roller-driving gear 287 and the reduction gear 282 and includes first and second clutches 285 and 286.

The first clutch 285 is inserted on a key 2881 formed on a rotational shaft 288 and provided at a portion facing the second clutch 286 with a supporting portion 2852 that supports the second clutch 286. Driven teeth 2851 are formed in a stair shape around the supporting portion 2852.

The second clutch 286 is provided at a portion facing the first clutch 285 with driving teeth 2861 engaged with the driving teeth 2851 and at a portion facing the reduction gear 282 with a plurality of projections 2862 that are adapted to engage the concave portions 283. The locations of the reduction gear 282 and the one-way power transmission unit 284 are not limited to this exemplary embodiment, and may vary as far as they operate in a substantially similar manner.

The exposure unit 130 is provided to form an electrostatic latent image corresponding to a printing signal by radiating light on the photosensitive drum 121 and includes a plurality of exposure units 130C, 130M, 130Y, 130K that respectively correspond to the developers 120C, 120M, 120Y, and 120K.

The conveying belt 151 is supported by a plurality of rollers 152, 153, 154, and 155, rotates in a closed curve shape, and allows the recording media P, which is picked up from the cassette 110 and fed by the feeding roller 174, to sequentially face the developers 120C, 120C, 120Y, and 120K.

The plurality of transfer rollers 140 are disposed inside of the conveying belt 151, facing the developers 120C, 120M, 120Y, and 120K, respectively, with the conveying belt 151 interposed therebetween. The plurality of transfer rollers 140 transfer the toner image formed on the photosensitive drum 121 onto the recording media P conveyed by the conveying belt 151.

The fusing unit 160 is provided for fusing the toner image on the recording media P and includes a heating roller 161 heating the toner image and a pressing roller 162 pressing the recording media P toward the heating roller 161 while contacting the heating roller 161. In this case, the recording media P passes between the heating roller 161 and the pressing roller 162.

The paper discharging unit 170 is provided to discharge the recording media, on which the toner image is fused, out of the image forming apparatus when passing through the fusing unit 160 and includes a pair of rollers disposed to face each other. The recording media 170 discharged by the paper discharging unit 170 are stacked on a paper discharging plate 102.

According to exemplary embodiments of the present invention, by providing the one-way power transmission units on the developing roller-driving unit and the photosensitive-driving unit, the reverse rotations of the developing roller and the photosensitive drum may be prevented by idling the photosensitive-driving unit and the developing roller-driving unit when the developer is mounted on the main body.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A developer-driving device, comprising:

a photosensitive drum-driving unit that rotates a photosensitive drum; and a developing roller-driving unit that rotates a developing roller;

wherein each of the photosensitive drum-driving unit and the developing roller-driving unit includes a one-way power transmission unit and a reduction gear slidably installed on a rotational shaft to receive power from a driving motor; and the one-way power transmission unit idles when a developer is being mounted on a main body and transmits power to the photosensitive drum and the developing roller after the developer is mounted on the main body;

wherein the one-way power transmission unit includes a first clutch fixed on the rotational shaft and provided with concave portions, and a second clutch installed between the first clutch and the reduction gear with projections inserted in the concave portions of the first clutch and having driven teeth of the second clutch facing the reduction gear.

2. The developer-driving device of claim 1, wherein each of the photosensitive drum-driving unit and the developing roller-driving unit further includes a photosensitive drum-driving gear fixed on the rotational shaft of the photosensitive drum-driving unit and connected to the photosensitive drum; and a developing roller-driving gear is fixed on the rotational shaft of the developing roller-driving unit and is connected to the developing roller.

3. The developer-driving device of claim 1, wherein the reduction gear is disposed on the rotational shaft such that driving teeth of the reduction gear are adapted to engage the driven teeth of the second clutch to transmit rotational force to the second clutch.

4. The developer-driving device of claim 1, wherein the one-way power transmission unit includes a first clutch fixed on the rotational shaft and provided with driven teeth; and a second clutch disposed between the first clutch and the reduction gear and having driving teeth adapted to engage the driven teeth of the first clutch and having a plurality of projections facing the reduction gear.

5. The developer-driving device of claim 4, wherein the reduction gear is is disposed on the rotational shaft such that a plurality of concave portions receive the projections of the second clutch to transmit rotational force to the second clutch.

6. The developer-driving device of claim 1, wherein the photosensitive drum and the developing roller contact each other.

7. The developer-driving device of claim 1, wherein the rotational shaft has a keyed portion adapted to receive each of the first clutches and the driving gears thereon.

8. The developer-driving device of claim 1, wherein the first clutch has a support portion adapted to receive the second clutch.

9. An image forming apparatus, comprising:

a plurality of photosensitive drums;

a plurality of developers each having a developing roller that develops an electrostatic latent image formed on one of the photosensitive drums;

a conveying unit that conveys paper in response to the developers; and a developer-driving device that drives the developers, wherein the developer-driving device includes a photosensitive drum-driving unit that rotates the photosensitive drum;

a developing roller-driving unit that rotates the developing roller;

wherein each of the photosensitive drum-driving units and the developing roller-driving units includes a one-way power transmission unit and a reduction gear slidably installed on a rotational shaft to receive power from a driving motor;

the one-way power transmission unit idles when the developer is being mounted on a main body and transmits power to the photosensitive drum and the developing roller after the developer is mounted on the main body;

wherein the one-way power transmission unit includes a first clutch fixed on the rotational shaft and provided with concave portions, and a second clutch installed between the first clutch and the reduction gear with projections facing and inserted in the concave portions of the first clutch and having driven teeth facing the reduction gear.

10. The image forming apparatus of claim 9, wherein each of the photosensitive drum-driving units and the developing roller-driving units further includes a photosensitive drum-driving gear fixed on the rotational shaft of the photosensitive drum-driving unit and connected to the photosensitive drum; and a developing roller-driving gear is fixed on the rotational shaft of the developing roller-driving unit and is connected to the developing roller.

11. The image forming apparatus of claim 9 wherein the reduction gear has driving teeth facing the second clutch to engage the driven teeth to transmit rotational force to the second clutch.

12. The image forming apparatus of claim 9 wherein the one-way power transmission unit includes a first clutch fixed on the rotational shaft and provided with driven teeth; and a second clutch disposed between the first clutch and the reduction gear and having driving teeth facing the first clutch to engage the driven teeth and having a plurality of projection facing the reduction gear.

13. The image forming apparatus of claim 12, wherein the reduction gear has a plurality of concave portions facing the second clutch into which the projections are inserted to transmit rotational force to the second clutch.

14. The image forming apparatus of claim 9, wherein the photosensitive drum and the developing roller contact each other.

15. The image forming apparatus of claim 9 wherein the rotational shaft has a keyed portion adapted to receive each of the first clutches and the driving gears thereon.

16. The image forming apparatus of claim 9, wherein the first clutch has a support portion adapted to receive the second clutch.

* * * * *